US007748434B2

(12) United States Patent
Wagstaff

(10) Patent No.: US 7,748,434 B2
(45) Date of Patent: Jul. 6, 2010

(54) SEQUENTIAL CASTING OF METALS HAVING HIGH CO-EFFICIENTS OF CONTRACTION

(75) Inventor: Robert Bruce Wagstaff, Greenacres, WA (US)

(73) Assignee: Novelis Inc., Toronto (CA)

( * ) Notice: Subject to any disclaimer, the term of this patent is extended or adjusted under 35 U.S.C. 154(b) by 194 days.

(21) Appl. No.: 11/712,672

(22) Filed: Feb. 28, 2007

(65) Prior Publication Data

US 2007/0215313 A1 Sep. 20, 2007

Related U.S. Application Data

(60) Provisional application No. 60/777,914, filed on Mar. 1, 2006.

(51) Int. Cl.
*B22D 11/00* (2006.01)

(52) U.S. Cl. ..... 164/461; 164/418; 164/419

(58) Field of Classification Search ..... 164/461, 164/485, 488, 489, 443, 441, 437, 418, 419
See application file for complete search history.

(56) References Cited

U.S. PATENT DOCUMENTS 3,212,142 A 10/1965 Moritz
3,353,934 A 11/1967 Robinson
3,717,197 A * 2/1973 Strack et al. ..... 164/420
4,567,936 A 2/1986 Binczewski
6,260,602 B1 7/2001 Wagstaff
6,495,269 B1 12/2002 Haszler et al.
6,705,384 B2 3/2004 Kilmer et al.
2005/0011630 A1 1/2005 Anderson et al.
2007/0215312 A1 9/2007 Gallerneault
2008/0008903 A1 1/2008 Bull et al.

OTHER PUBLICATIONS

G.J. Binczewski and W.K. Kramer, "Simultaneous Casting of Alloy Composites", Light Metals 1972, Proceedings of Sessions, 101st AIME Annual Meeting, San Francisco, California, Feb. 20-24, 1972, pp. 465-481.

* cited by examiner

*Primary Examiner*—Jessica L Ward
*Assistant Examiner*—Erin B Saad
(74) *Attorney, Agent, or Firm*—Cooper & Dunham LLP

(57) ABSTRACT

A method and apparatus for casting metals in a DC mold to form an ingot or product having at least two layers formed by sequential solidification. The apparatus has at least one cooled divider wall at the entry end portion of the mold to divide the entry end portion into at least two feed chambers. Metal is fed to the chambers to form an inner layer and at least one outer layer. The divider wall has a metal-contacting surface for contacting the metal for the at least one outer layer, the surface being arranged at an angle to the vertical sloping away from the metal for the outer layer in a downward direction. The angle increases at positions on the divider wall spaced from a central section of the wall approaching each longitudinal end thereof. The apparatus is suitable for casting a metal having a high coefficient of contraction as an inner layer or core ingot, e.g. a high-Mg or high-Zn aluminum alloy, or metal combinations having a large difference in their coefficients of contraction.

9 Claims, 9 Drawing Sheets

SEQUENTIAL CASTING OF METALS HAVING HIGH CO-EFFICIENTS OF CONTRACTION

CROSS-REFERENCE TO RELATED APPLICATIONS

This application claims the priority right of our prior co-pending U.S. provisional patent application Ser. No. 60/777,914, filed Mar. 1, 2006.

BACKGROUND OF THE INVENTION (1) Field of the Invention

This invention relates to the casting of metals, particularly aluminum and aluminum alloys, by direct chill (DC) casting techniques. More particularly, the invention relates to the co-casting of metal layers by direct chill casting involving sequential solidification.

(2) Description of the Related Art

Metal ingots are commonly produced by direct chill casting of molten metals. This involves pouring a molten metal into a mold having cooled walls, an open upper end and (after start-up) an open lower end. The metal emerges from the lower end of the mold as a metal ingot that descends as the casting operation proceeds. In other cases, the casting takes place horizontally, but the procedure is essentially the same. Such casting techniques are particularly suited for the casting of aluminum and aluminum alloys, but may be employed for other metals too.

Casting techniques of this kind are discussed extensively in U.S. Pat. No. 6,260,602 to Wagstaff, which relates exclusively to the casting of monolithic ingots, i.e. ingots made of the same metal throughout and cast as a single layer. Apparatus and methods for casting layered structures by sequential solidification techniques are disclosed in U.S. Patent Publication No. 2005/0011630 A1 to Anderson et al. Sequential solidification involves the casting of a first layer (e.g. a layer intended as an inner layer or core) and then, subsequently but in the same casting operation, casting one or more layers of other metals on the first layer once it has achieved a suitable degree of solidification.

While these techniques are effective and successful, difficulties may be encountered when attempting to employ the sequential solidification technique with one or more alloys that have high coefficients of contraction upon solidification and cooling. In particular, when such a metal is employed as an inner layer forming a substrate for an outer layer of another metal, it is found that the inner layer may have a tendency to shear off the outer layer (or exhibit weakened adhesion) during the casting operation, especially at the extreme ends of a rectangular ingot cast with a layered structure, and especially during the initial stage of ingot formation.

It is known that the addition of other elements to pure aluminum changes its coefficient of contraction to a greater or lesser degree. Some elements increase the coefficient of contraction, while others reduce it. Elements such as magnesium and zinc increase the coefficient compared to pure aluminum, whereas elements such as copper, iron, silicon and nickel reduce the coefficient. The degree to which the coefficient is changed generally varies in an approximately linear manner with the percentage of the element added to the aluminum.

The difficulties referred to above, while potentially experienced with all sequentially-cast metal structures, tend to be more acute when an inner layer is made from an aluminum alloy that has a high coefficient of contraction and, especially, a higher coefficient than aluminum itself, particularly an aluminum alloy containing magnesium and/or zinc, especially when such elements are contained in relatively high concentrations, e.g. Mg in amounts more than about 2.5 wt. %. However, similar problems may be encountered when the coefficient of contraction of a metal of one layer is not particularly high, but there is a large difference between the coefficients of two adjacent layers, e.g. an alloy containing significant quantities of nickel in one layer and an alloy containing copper in an adjacent layer. While both these elements cause a reduction of the coefficient compared to pure aluminum, nickel has a much more negative effect on the coefficient than copper so that, depending on the relative concentrations of these elements, the difference in the respective coefficients can be quite large.

There is therefore a need for improved casting equipment and techniques when co-casting metals of these kinds.

BRIEF SUMMARY OF THE INVENTION

An exemplary embodiment of the invention provides apparatus for casting a composite metal ingot. The apparatus includes an open-ended generally rectangular mold cavity having an entry end portion, a discharge end opening, and a movable bottom block adapted to fit within the discharge end and to move axially of the mold during casting. The apparatus also has at least one cooled divider wall at the entry end portion of the mold and terminating above the discharge end opening to divide the entry end portion into at least two feed chambers, and means for feeding metal for an inner layer to one of the feed chambers and at least one means for feeding another metal for at least one outer layer to another of the feed chambers. The or each divider wall has a metal-contacting surface for contacting the metal for the at least one outer layer, the surface being arranged at an angle to the vertical sloping away from the metal for the outer layer in a downward direction, and the angle increasing at positions on the at least one divider wall spaced from a central section of the divider wall to each longitudinal end thereof.

Another exemplary embodiment provides a method of casting a composite ingot. The method includes providing an apparatus for casting a composite metal ingot, having an open-ended generally rectangular mold cavity provided with an entry end portion, a discharge end opening, a movable bottom block adapted to fit within the discharge end and to move axially of the mold during casting, and at least one cooled divider wall at the entry end portion of the mold and terminating above the discharge end opening to divide the entry end portion into at least two feed chambers for casting an inner layer and at least one outer layer, the at least one divider wall having a metal-contacting surface for contacting metal introduced for the at least one outer layer. The surface is arranged at an angle to the vertical sloping away from the metal for the outer layer in a downward direction, and the angle increases at positions approaching each longitudinal end of the wall. The method further includes feeding metal for an inner layer to one of the at least two feed chambers, feeding another metal for at least one outer layer to at least one other of the feed chambers, and moving the bottom block axially of the mold to allow an ingot to emerge from the discharge end opening of the apparatus.

Yet, another exemplary embodiment provides, in a method of casting an inner layer made of a metal and at least one metal cladding layer of another metal in a direct chill casting apparatus having at least one divider wall forming at least two chambers in the apparatus, wherein the metal for the inner layer has a higher coefficient of contraction than the metal of the at least one outer layer, the improvement which comprises angling the at least one divider wall at an angle to the vertical for contacting but sloping away in a downward direction from metal supplied for the at least one outer layer, and increasing the angle at positions approaching the longitudinal ends of the divider wall.

It should be appreciated that the term "rectangular" as used in this specification is meant to include the term "square".

DETAILED DESCRIPTION OF THE EXEMPLARY EMBODIMENTS

The present invention may employ casting apparatus of the type described, for example, in U.S. Patent Publication No. 2005/0011630, published on Jan. 20, 2005 in the name of Anderson et al. (the disclosure of which is incorporated herein by reference). This apparatus makes it possible to cast metals by sequential solidification to form at least one outer layer (e.g. a cladding layer) on an inner layer (e.g. a core ingot). The invention also extends techniques disclosed in U.S. Pat. No. 6,260,602 to Wagstaff (the disclosure of which is also incorporated herein by reference).

It should be explained that the terms "outer" and "inner" are used herein quite loosely. For example, in a two-layer structure, there may strictly speaking be no outer layer or inner layer, but an outer layer is one that is normally intended to be exposed to the atmosphere, to the weather or to the eye when fabricated into a final product. Also, the "outer" layer is often thinner than the "inner" layer, usually considerably so, and is thus provided as a thin coating layer on the underlying "inner" layer or core ingot. In the case of ingots intended for hot and/or cold rolling to form sheet articles, it is often desirable to coat both major (rolling) faces of the ingot, in which case there are certainly recognizable "inner" and "outer" layers. In such circumstances, the inner layer is often referred to as a "core" or "core ingot" and the outer layers are referred to as "cladding" or "cladding layers".

Figure 1:
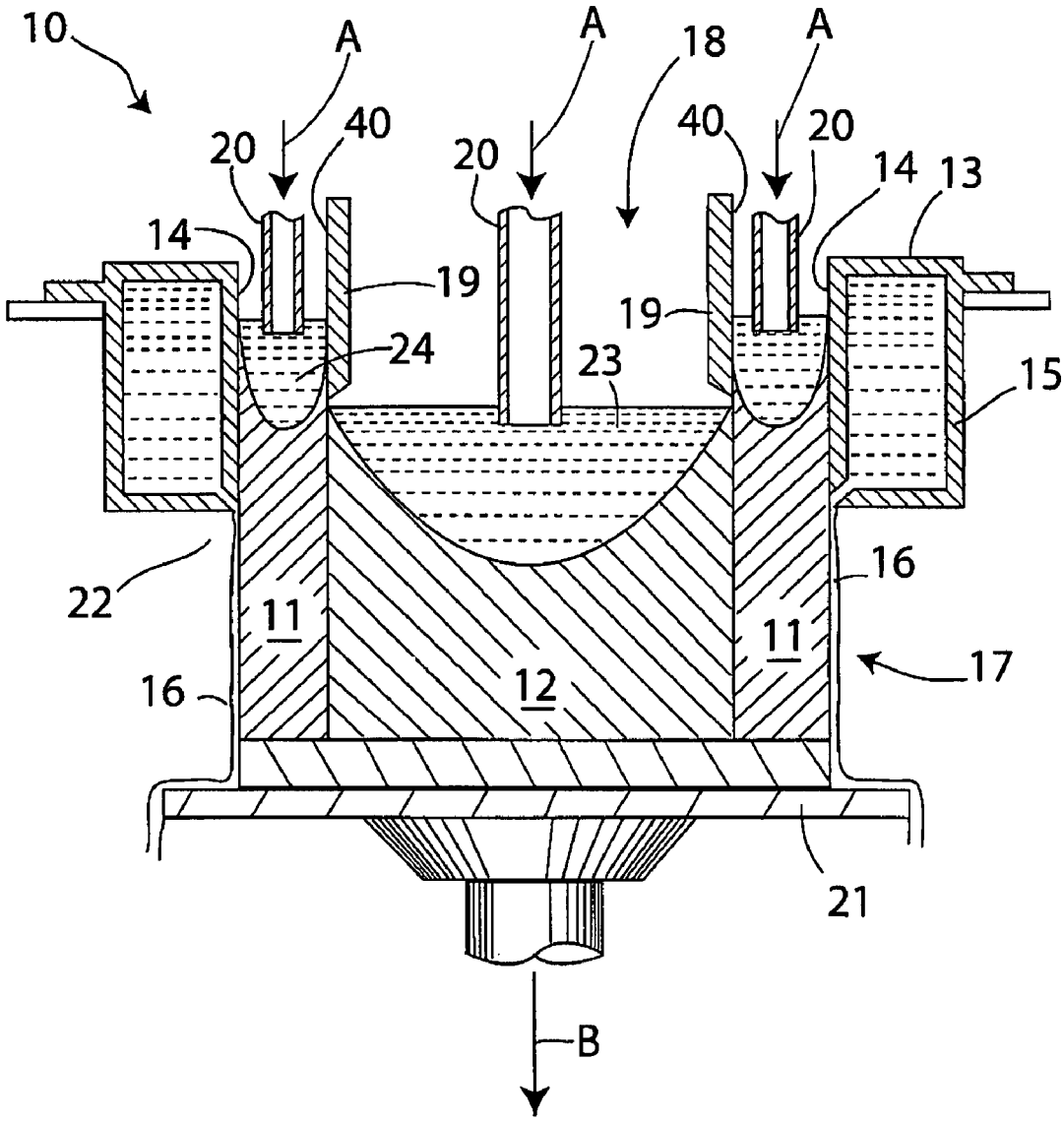
FIG. 1 is an elevation in partial vertical cross-section showing a casting apparatus having single divider wall.

FIG. 1 shows a version 10 of the Anderson et al. apparatus used for casting an outer layer 11 on both major surfaces (rolling faces) of a rectangular inner layer or core ingot 12. It will be noticed that, in this version of the apparatus, the coating layers are solidified first (at least partially) during casting and then the core layer is cast in contact with the outer layers. This arrangement is typical when casting an alloy having a high coefficient of contraction (e.g. a high Mg alloy) as the core layer 12. The apparatus includes a rectangular casting mold assembly 13 that has mold walls 14 forming part of a water jacket 15 from which a stream 16 of cooling water is dispensed onto an emerging ingot 17. Ingots cast in this way generally are of rectangular cross-section and have a size of up to 70 inches by 35 inches. They are usually used for rolling into clad sheet, e.g. brazing sheet, in a rolling mill by conventional hot and cold rolling procedures.

The entry end portion 18 of the mold is separated by divider walls 19 (sometimes referred to as "chills" or "chill walls") into three feed chambers, one for each layer of the ingot structure. The divider walls 19, which are often made of copper for good thermal conductivity, are kept cool by means of water cooled cooling equipment (not shown) contacting the divider walls above the molten metal levels. Consequently, the divider walls cool and solidify the molten metal that comes into contact with them. As indicated by the arrows A, each of the three chambers is supplied with molten metal up to a desired level by means of a separate molten metal delivery nozzle 20 equipped with an adjustable throttle (not shown). The metal chosen for the outer layers 11 is usually different from the metal of the core 12 (the latter being a metal having a high coefficient of contraction in this exemplary embodiment). A vertically movable bottom block unit 21 initially closes the open bottom end 22 of the mold, and is then lowered during casting (as indicated by the arrow B) while supporting the embryonic composite ingot as it emerges from the mold.

Figure 2:
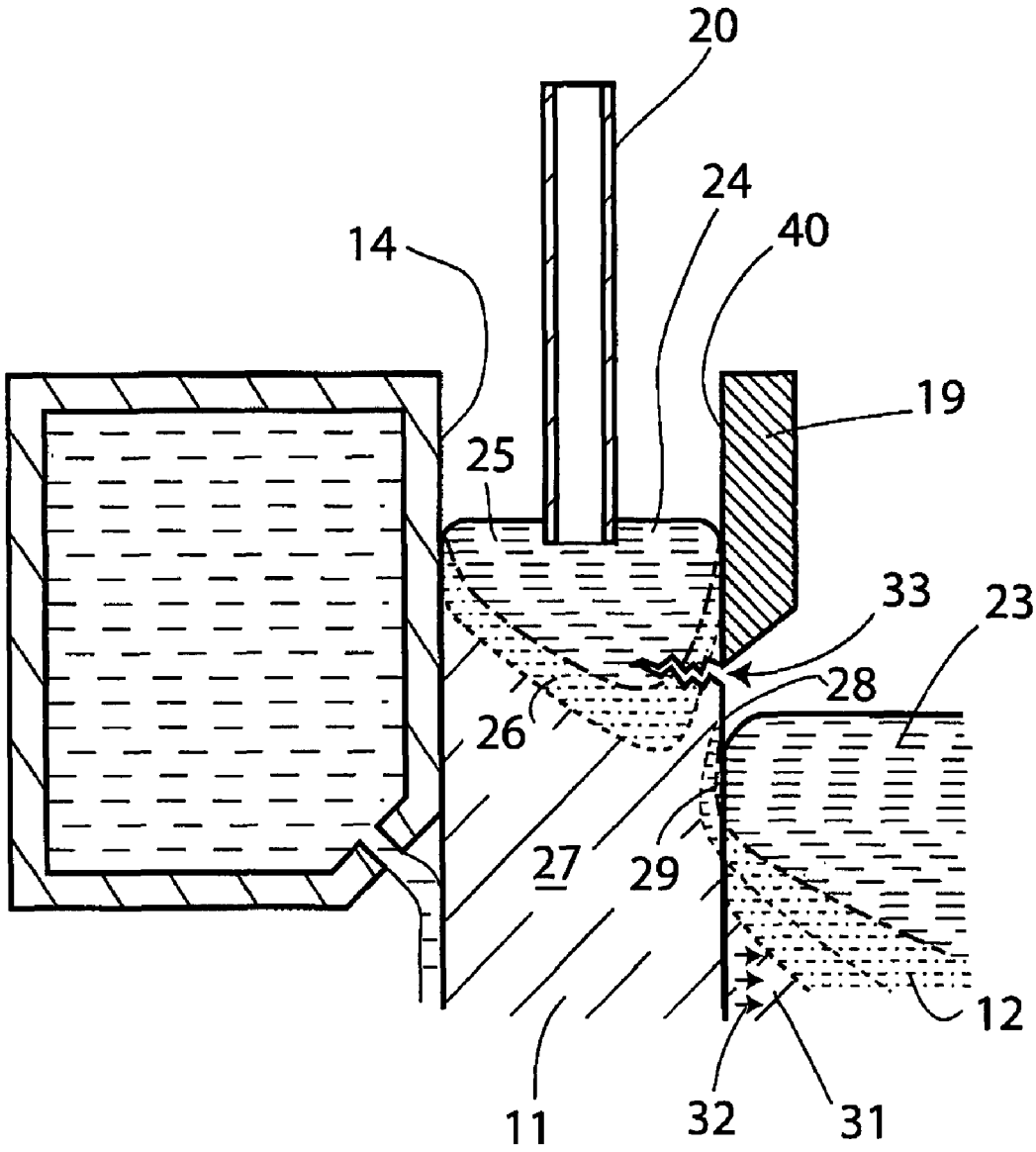
FIG. 2 is a schematic illustration of a region of contact between metal alloys in the apparatus of FIG. 1.

FIG. 2 is an enlargement of the region of the apparatus of FIG. 1 adjacent to the left hand divider wall 19 where the molten metal 23 of the core layer 12 and the molten metal 24 of the left hand cladding layer 11 come into mutual contact in the mold. Metal alloys, when cooling from liquid to solid, go through an intermediate semi-solid or "mushy" state when the temperature of the metal is between the liquidus temperature and the solidus temperature of the metal. The metal 24 forming the cladding layer 11 has a molten sump region 25, a semi-solid or mushy zone 26 generally below the molten sump, and a fully solid region 27 generally below the mushy zone, but these regions are contoured in the manner shown due to the cooling effects of the mold wall 14 and the divider wall 19. The inner surface 28 of the cladding layer 11 immediately below the cooled divider wall 19 is solid, but the shell of solid metal is quite thin as it surrounds the mushy zone 26 and molten sump 25. This surface is contacted with the molten metal 23 of the core layer 12 somewhat below the lower end of the divider wall, and heat from the molten metal re-melts a portion of the solid surface 28 of the cladding layer in a shallow region 29 in the shell. This re-melting provides good adhesion between the layers at their interface when they solidify. Below this region 29, the metal of the core layer falls below its liquidus temperature and a mushy zone 30 is formed with solid metal 31 further below. However, as the metal of the core layer becomes fully solid, it contracts strongly in the direction of arrows 32, i.e. inwardly towards the center of the ingot, due to its high coefficient of contraction. This draws the metal of the cladding layer 11 along with it, and thus pulls the entire inner surface 28 of the cladding layer inwardly. Movement of the cladding layer in this way is held back at its upper end by its contact with the divider wall 19, and the metal of the cladding layer may form a fracture 33 adjacent to the lower end of the divider wall, as shown. If such a fracture occurs, the casting procedure has to be terminated because molten metal of the core layer and the cladding layer mingle and the interface is no longer intact.

Figure 3:
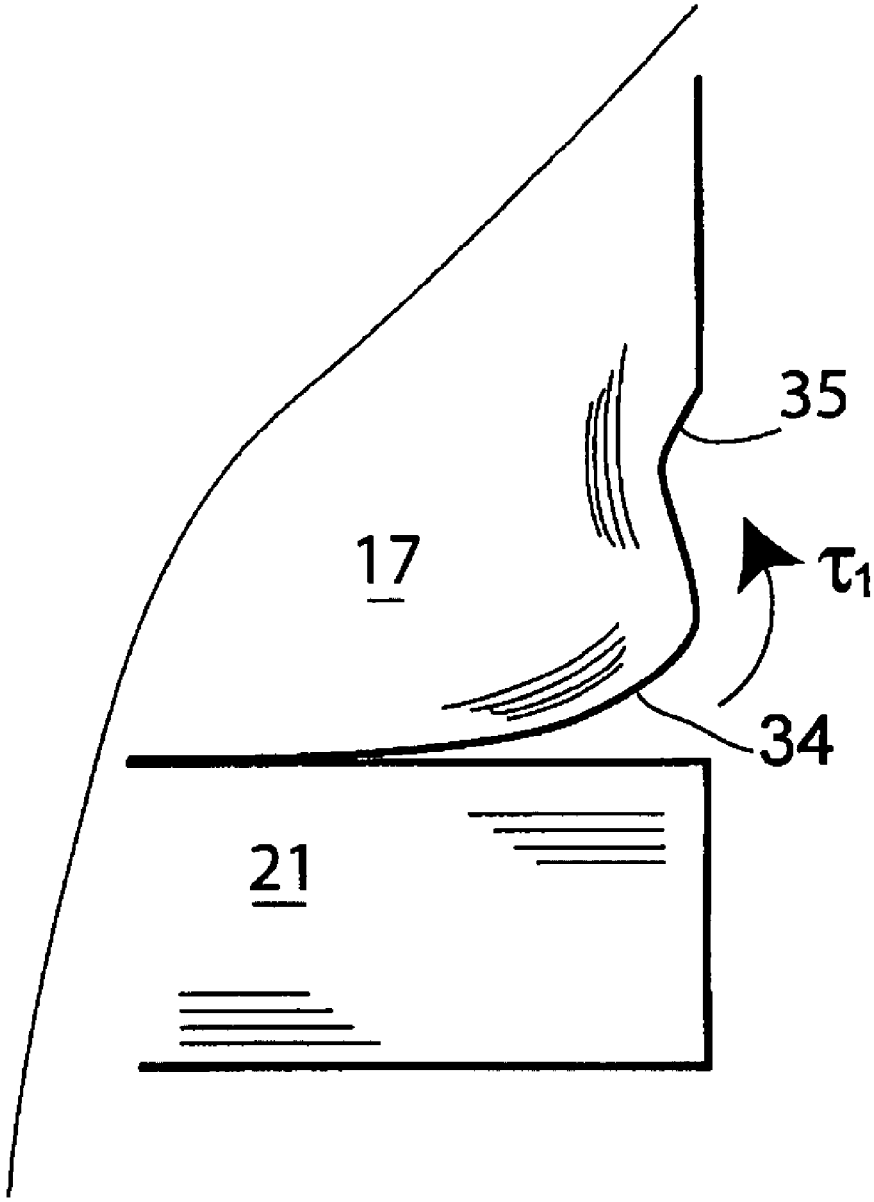
FIG. 3 is an elevation of part of the casting apparatus of FIG. 1 showing an example of butt-curl produced during ingot casting.

Fracturing of this kind is most likely to occur during the early stage of ingot formation, i.e. during the emergence of the first 12 to 30 inches of the ingot from the mold. This is because of the extra stresses imposed on the ingot at this time by the well-known phenomenon of "butt curl" which is encountered at the start of the casting process. This phenomenon is illustrated in simplified and exaggerated schematic form in FIG. 3 which shows a region of a bottom of the emerging ingot 17 at one longitudinal end thereof, looking at one of the clad faces. At the very bottom 34 of the ingot, the metal contacts the bottom block 21, which has a substantial heat capacity and thus rapidly cools the ingot at its bottom end. In this region, the ingot is therefore cooled both from the bottom and from the sides (by primary cooling from the cooled mold surfaces and secondary cooling from a water spray or jet 16 contacting the ingot immediately below the mold). As the ingot emerges further and grows in length, the cooling influence of the bottom block diminishes because of the increased distance, and cooling then takes place primarily from the sides of the ingot. The combination of the cooling from the bottom the cooling from the sides makes the initial region of the ingot curl in the manner shown. The lower ends of the ingot feel the influence of a torque $\tau_1$ that lifts the corners of the ingot and causes the wall of the ingot to bow inwardly at 35. It will be appreciated that the resulting vertical stress imposed on the ingot in these locations in combination with the horizontal stress imposed by the contraction of the core metal to substantially increase the risk of fracture of the cladding layers.

It is also generally the case that the initial stage of casting is carried out at a faster rate than the casting that takes place after the initial stage. This can create deeper sumps of molten metal in the various layers and this, in turn, increases the contraction force generated by the core metal (the forces being generated along the surface of solidification, as will be explained more fully later). For this reason also, fracture is more likely during the initial stage of casting than later in the process.

Figure 4:
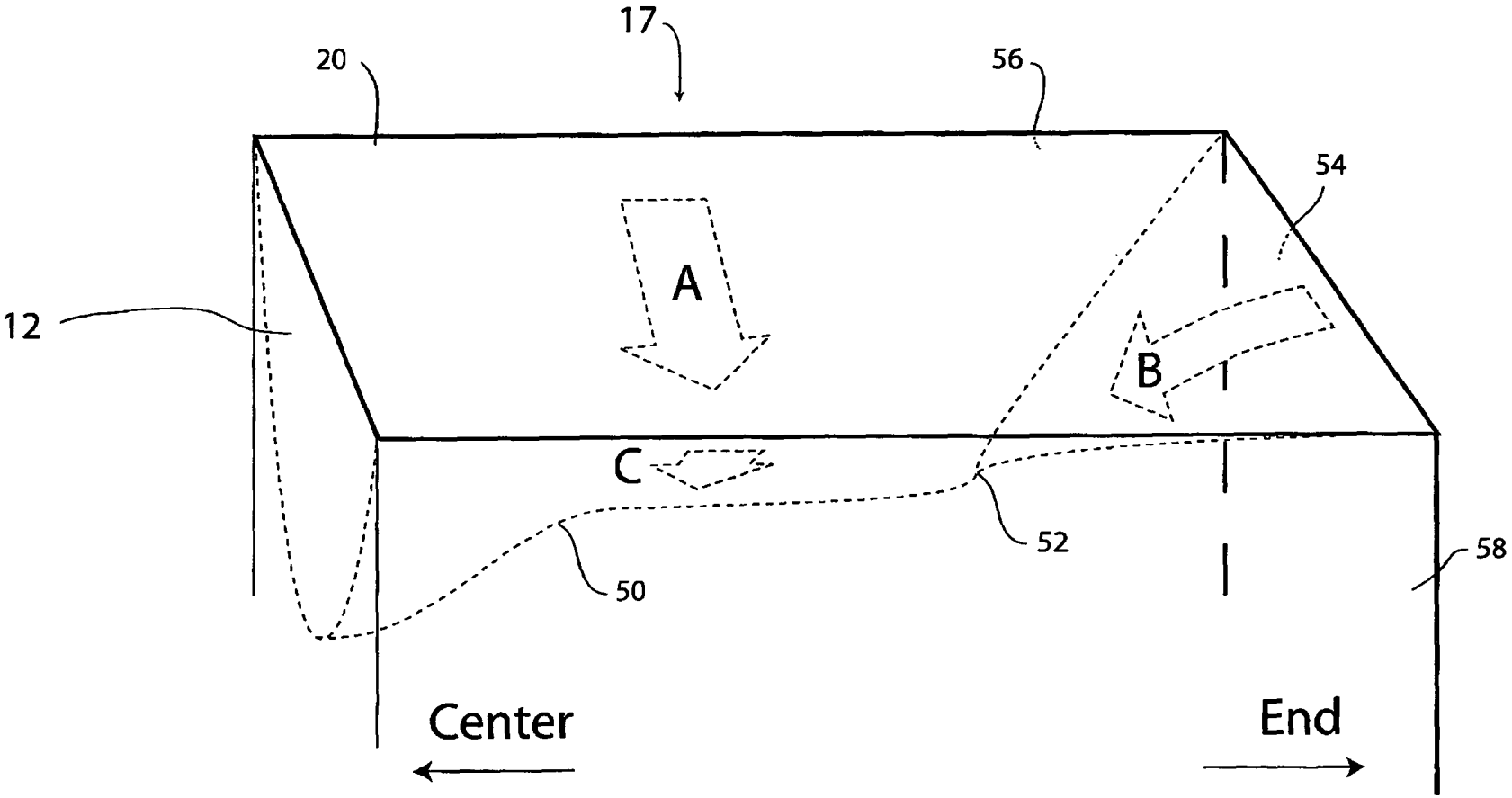
FIG. 4 is a three-dimensional representation of an end part of an inner layer during casting showing the lines of solidification of the metal and the contraction forces.

As well as being more likely to occur during the initial stage of casting, the indicated fracture or metal failure becomes more likely in the regions at the longitudinal ends of the ingot than at the ingot center. The reason for this can be explained as follows. FIG. 4 is a diagram representing one longitudinal end of a rectangular ingot 17 (showing just the inner layer 12 for simplicity) as it is cast in an apparatus of the kind shown in FIG. 1. The broken line 50 is the line of transition from liquid to solid within the ingot—the so-called line of thermal convergence (more accurately referred to as a surface). It will be seen that the line is quite deep towards the longitudinal center of the ingot where the metal is close to the molten metal feed nozzle 20 (FIG. 1), and becomes more shallow and flat towards the extreme longitudinal end of the ingot. However, at point 52, the line of thermal convergence bifurcates and extends upwardly to each corner of the ingot. This is because of the cooling that takes place from the end surface 54 of the ingot as well as the side surfaces 56 and 58. As the metal solidifies at the line of thermal convergence, contraction takes parallel to the solidification surfaces as shown by arrows A, B and C. At positions on the ingot more central than the bifurcation point 52, the ingot is being cooled, and thus contracts, generally equally from each side surface, but beyond the bifurcation point towards the end of the ingot, the cooling (heat loss) and contraction from the end surface 54 becomes more influential as the end surface is approached. This causes the ingot to curl or torque inwardly at the ends of the side surfaces, as explained in more detail in the following.

Figure 5:
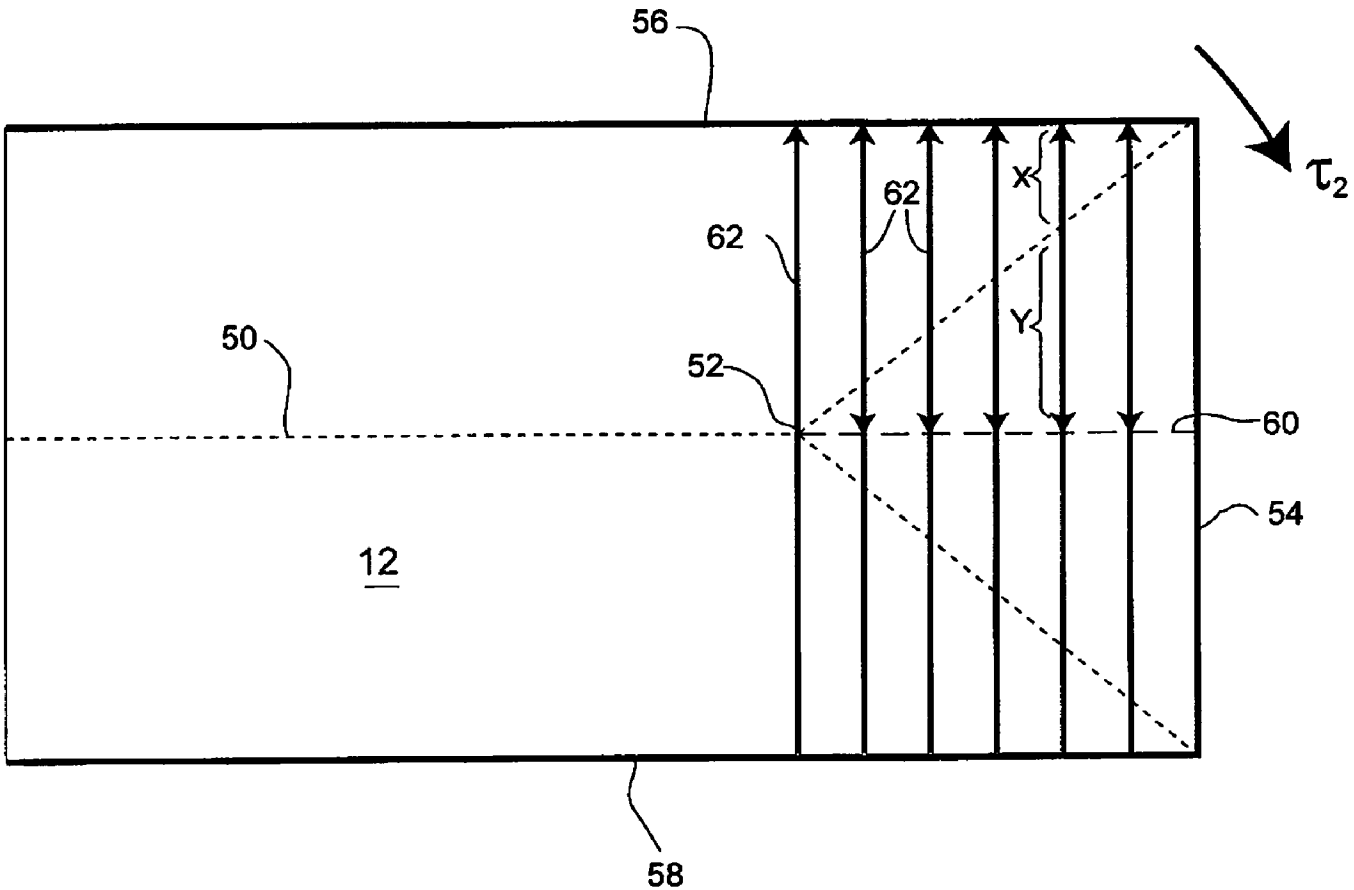
FIG. 5 is a plan view of the end part of the inner layer of FIG. 4 showing forces acting on the metal.

The forces acting at the upper end of the ingot are shown in FIG. 5. At the part of the ingot beyond bifurcation point 52 towards end surface 54, the top of the ingot is acted upon by forces (represented by double headed arrows 62) acting both outwardly from a center line 60 towards a side surface, e.g. side surface 56 (forces X) and forces acting inwardly towards the center line 60 (forces Y). As the end surface is approached, the outwardly directed force X becomes progressively smaller than the inwardly directed force Y because the change in direction of the force takes place along the bifurcations of the line of thermal convergence 50. This causes a torsional rotation or torque $T_2$, as shown in FIG. 5, to act on a corner of the ingot, thus tending to turn the corner in towards the center of the shorter side 54. As a result, the ingot takes on a shape illustrated in greatly exaggerated form in FIG. 6 set against a rectangular "ideal" shape 59. It can be seen that the outer surfaces 56 and 58 thus curl inwardly at the extreme ends of the ingot and it is believed that this curl adds to the stresses imposed on the cladding layers and increases the tendency of the layers to separate in this region as the ingot is being cast. For the reasons explained earlier, the outer metal layer (not shown), as it contacts the inner layer or ingot, cannot easily follow this inward turn as it is held back by the divider wall 19. The likelihood of fracture is therefore increased in the end regions.

The exemplary embodiments overcome this problem by tapering or angling the divider walls 19 at the surface 40 that contacts the metal of the cladding layer(s), and increasing the angle of taper (slope of the surface) of the divider walls at points between the center and the longitudinal ends of the ingot to accommodate both the shrinkage of the ingot and the additional forces produced by butt-curl and in-turning of the core ingot at its longitudinal ends. For example, for casting apparatus of the type shown in FIG. 1, the divider wall 19 may be tapered or angled from the vertical by an angle that is preferably in the range of 0 to 2°, but preferably 1 to 2°. This means that the surface 40 of the divider wall 19 that contacts and restrains the metal of the outer or cladding layer slopes inwardly towards the core layer in the direction from top to bottom of the divider wall. Moreover, the angle of taper of the divider wall is increased at the longitudinal ends of the mold, e.g. to a range of 3 to 7°, or more preferably 3 to 4°, for a conventionally-sized ingot. The angles selected may depend on the coefficient of contraction of the metal of the inner layer (normally, the higher the coefficient, the higher should be the angle of taper required at both the center and the longitudinal ends). For comparison, when casting a monolithic ingot of a metal that does not have high coefficient of contraction, the taper angle of the divider wall may be about 1.5° and would stay the same for the entire length of the divider wall.

The increase in taper of the divider walls towards their respective ends is illustrated schematically in FIGS. 7A to 7D, in which the angle of taper at the center is represented as angle θ, and the angle of taper at the longitudinal ends is represented by angle θ'. The angle θ' at the ends is preferably at least twice the angle θ at the center, but this may depend on the particular alloys employed. Any degree of increase in the angle of taper towards the ends of the divider wall is often found to be beneficial, but the preferred doubling or more gives significant improvements. The most preferred angle for any particular set of circumstances can easily be determined empirically by carrying out test casting operations using different angles and observing the results. In contrast to the angling of the divider walls, the mold wall 11 may be vertical or may itself be tapered, i.e. sloping outwardly towards the bottom of the mold (in which case the angle of taper would normally be up to about 1°). When a taper of this kind is employed for the mold wall 11, however, it is generally kept the same for the entire length of the mold.

Figure 8:
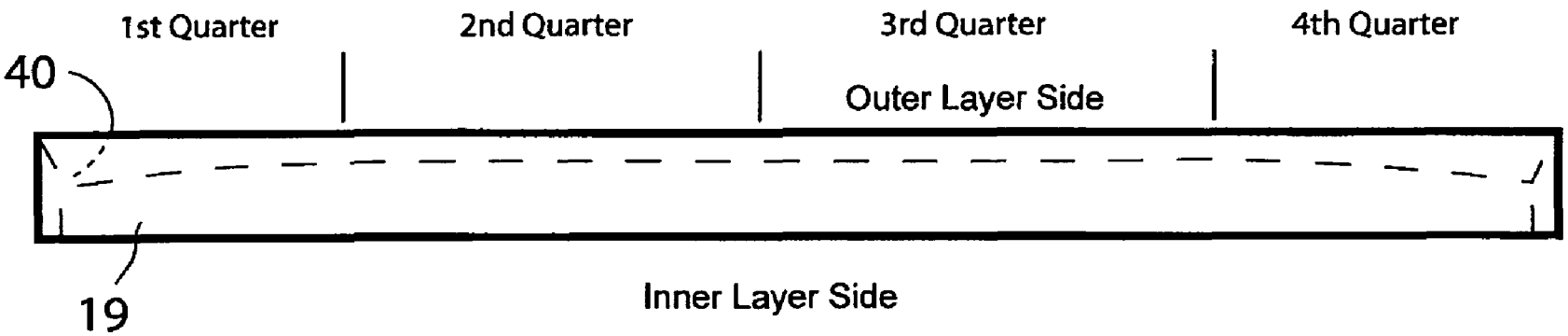
FIG. 8 is an alternative exemplary embodiment of a divider wall according to the present invention.

The increase in angle of taper of the surface 40 of divider wall 19 may take place gradually and linearly along the length of the divider wall from the center to the longitudinal ends on each longitudinal side. However, it is not always necessary to increase the angle of taper in this way. It is found that, in a region of the divider wall from the center of the mold to a point in line with the start of the bifurcation 52 within the ingot, there may be need for little or no increase in the angle of taper. Therefore, the angle of taper may remain constant in an elongated central region and may then increase in end regions spaced along the divider wall from the center of the mold. In the end regions, the increase in may take place gradually, which is preferred, or the angle of taper may increase rapidly to the maximum angle of taper over a short distance at the start of the region and then remain constant throughout the remainder of the region to the ends of the divider wall. As a general approximation, in the exemplary embodiments, the positions where the angle of taper commences to increase on each side of the center may be taken as the quarter points of the ingot length. That is to say, the central region of constant (minimum) taper extends across the central region (the second and third quarters) to approximately the quarter and three quarter points along the divider wall, and then the angle of taper increases in the more distant first and fourth quarters. A divider wall tapered in this way is shown in FIG. 8.

Figure 6:
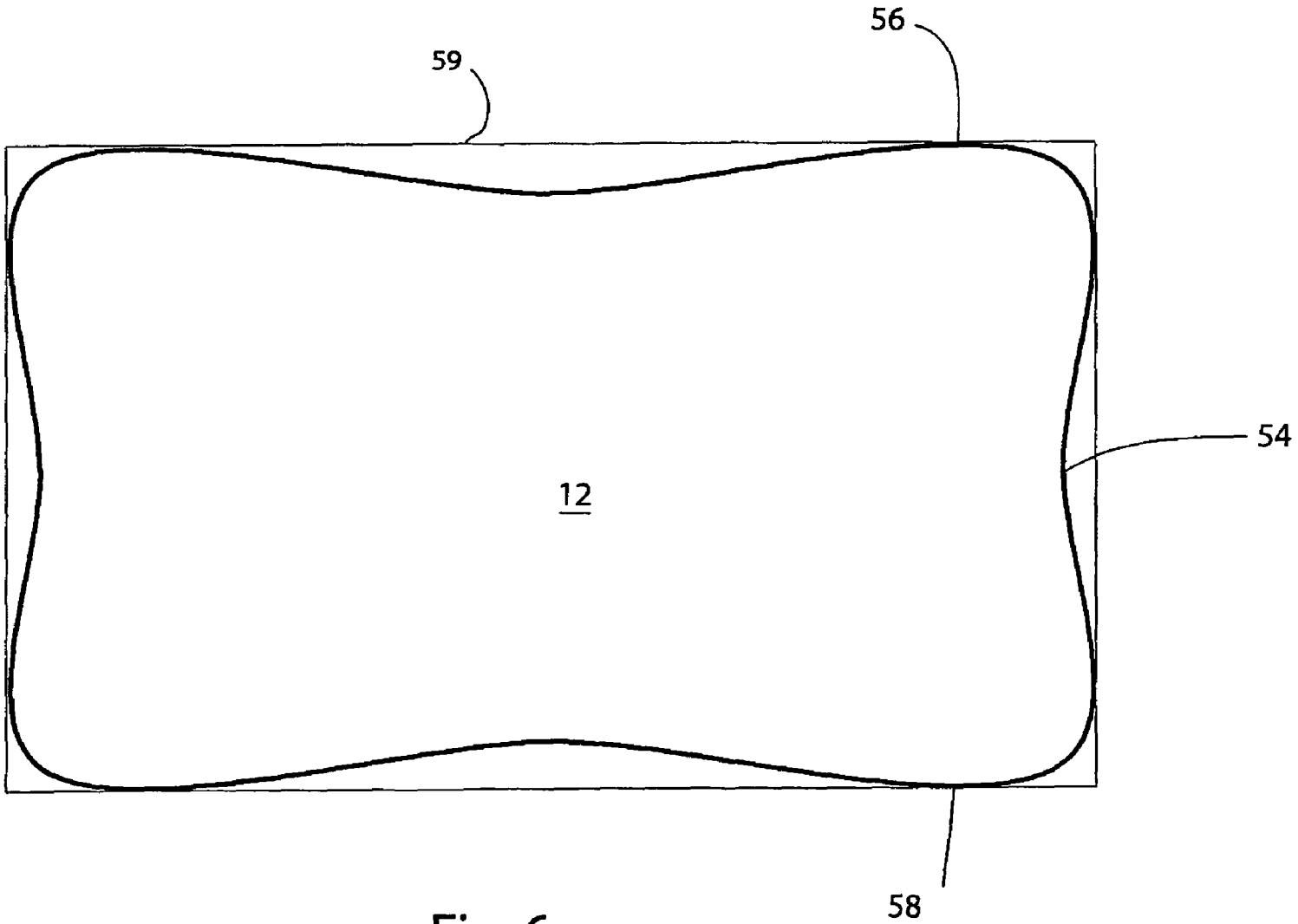
FIG. 6 is a plan view of an inner layer (core ingot) showing, in exaggerated form, distortions of the ideal rectangular shape caused by forces acting on the metal.
Figures 7A, 7B, 7C, 7D:
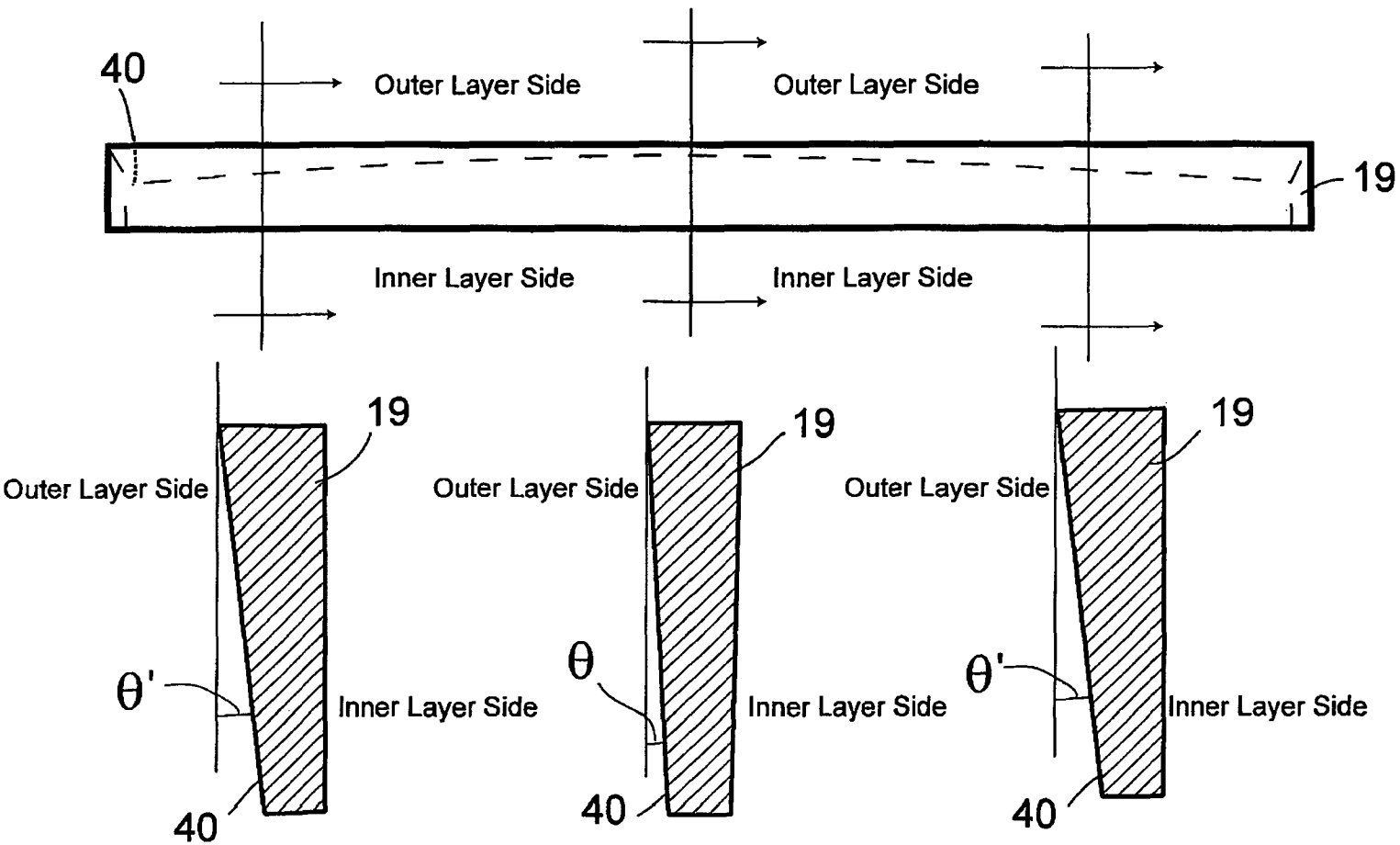
FIGS. 7A to 7D are drawings illustrating one form of a divider wall used in the apparatus of FIG. 9 in perspective and illustrative cross-sections.

As well as being tapered at an increasing angle along its length, divider wall 19 may also be arched outwardly (in the manner shown in FIG. 7 of U.S. 2005/0011630) to accommodate contraction of the long side faces 56 and 58 of the ingot during cooling and solidification. This will compensate for the "bowing-in" of these faces as shown in FIG. 6 and produce side surfaces closer to the ideal planar shape that is desirable for rolling into sheet articles.

Figure 9:
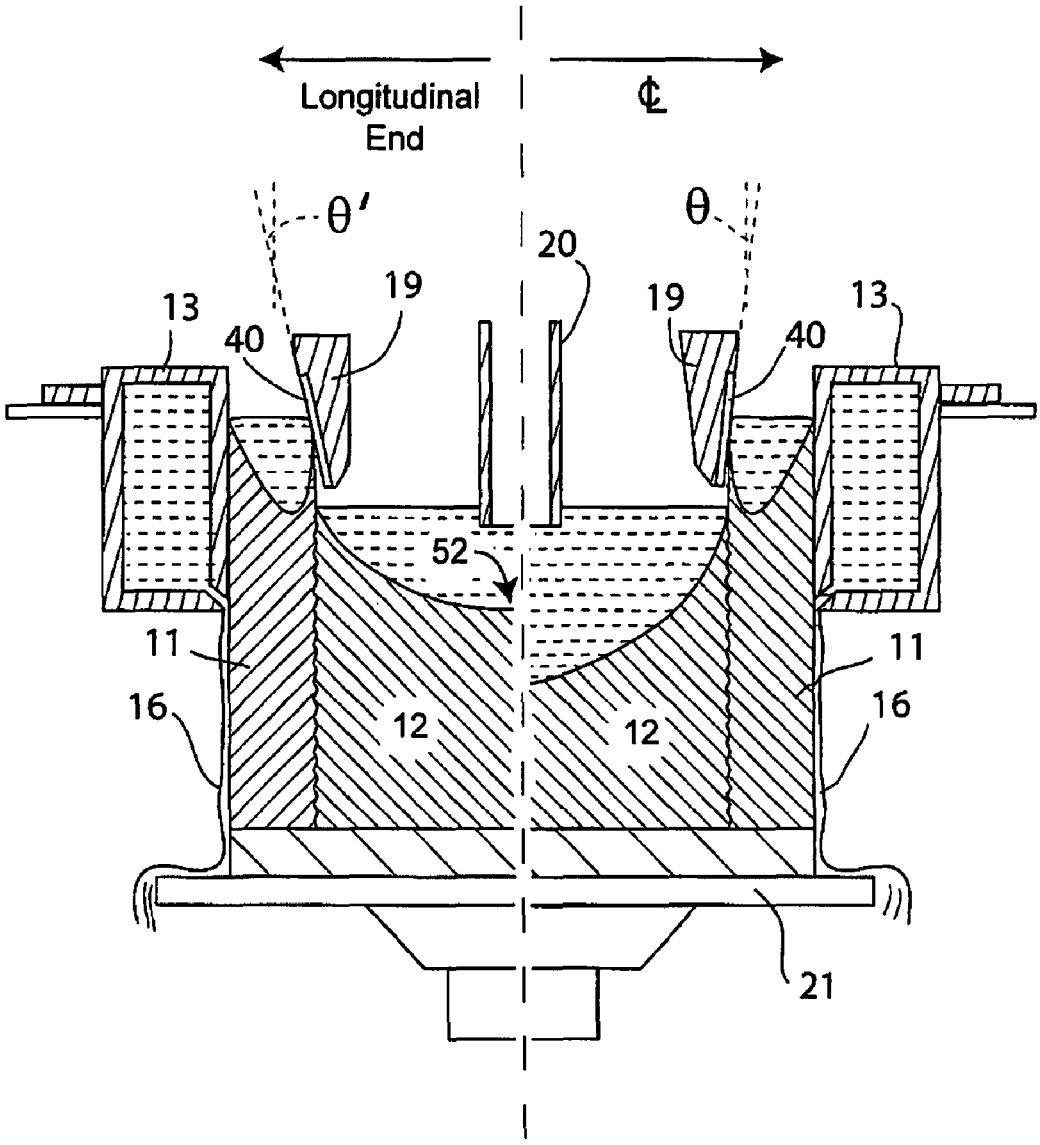
FIG. 9 is a vertical cross-section of a casting apparatus configured according to one exemplary embodiment of the present invention.

FIG. 9 is a view similar to that of FIG. 1 showing a casting apparatus according to one exemplary embodiment of the invention. The figure is split vertically down the center of the casting apparatus. The right hand side shows the apparatus in vertical cross-section at the longitudinal center point of the ingot, and the left hand side shows the casting mold at a position towards one longitudinal end of the ingot. The thermal bifurcation point 52 is indicated, but the left hand side of the drawing is actually shown as it will appear somewhat beyond this point further towards the end of the ingot. The two halves of the drawing show the different angles ($\theta$ and $\theta'$) of divider walls 19 at these different positions as well as the variation in the height of the central solidification point of the metal of the inner layer at these points. It will be seen that the angle of taper $\theta'$ towards the end of the ingot is much greater than at the center (angle $\theta$).

In the present invention, the alloy used to cast the inner layer may be a metal having a high coefficient of contraction, for example, a high-Mg or high-Zn aluminum alloy, e.g. an aluminum alloy containing at least 2.5 wt. % Mg, more preferably 2.5 to 15 wt. %, more preferably 2.5 to 9 wt. %, and even more preferably 2.5 to 7 wt. % Mg. Examples of suitable alloys are generally chosen from AA5xxx series and include alloys AA 5083, 5086, 5454, 5182 and 5754.

The alloy used for the cladding layer may be one that does not have a high coefficient of contraction, e.g. an aluminum alloy that does not contain any Mg or Zn at all, or one that does not have a very high concentration of Mg or Zn, e.g. an aluminum alloy containing 2 to 3 wt. % Mg or less.

However, it should be noted that the invention is also of benefit in those cases where there is a significant difference of coefficient of contraction between the metals of the inner and outer layer, even if the metals themselves do not have particularly high coefficients of thermal contraction, because such combinations may also show a tendency towards layer separation. For the purposes of this invention, the difference of coefficient of contraction is significant if it is large enough to result in occurrences of layer separation.

What is claim is:

1. Apparatus for casting a composite metal ingot, comprising:

an open-ended generally rectangular mold cavity having opposed longer side walls and opposed shorter end walls, an entry end portion, a discharge end opening, a movable bottom block adapted to fit within the discharge end opening and to move axially of the mold during casting;

at least one cooled divider wall having opposite longitudinal ends with each end positioned at a different one of said opposed end walls, said at least one divider wall being positioned at the entry end portion of the mold to divide the entry end portion of the mold into at least two feed chambers and terminating above said discharge end opening of the mold, said at least one divider wall being positioned closer to one of said opposed longer side walls than the other; and means for feeding metal for an inner layer to one of said at least two feed chambers and at least one means for feeding another metal for at least one outer layer to at least one other of said feed chambers;

wherein said at least one divider wall has a metal-contacting surface for contacting said metal for said at least one outer layer, said surface facing said one of said opposed side walls that is closer to the divider wall, said surface being arranged at an angle to the vertical sloping away from said metal for said outer layer in a downward direction, and said angle increasing at different horizontal positions along said at least one divider wall from a smaller angle at a center of said at least one divider wall to larger angles at positions on said at least one divider wall approaching each said longitudinal end thereof.

2. The apparatus of claim 1, wherein said at least one means for feeding said another metal for said at least one outer layer is positioned to introduce said metal for said outer layer into said mold at a position in said mold higher than said means for feeding said metal for said inner layer.

3. The apparatus of claim 1, wherein said angle of said at least one divider wall at said longitudinal ends is at least double said angle at a center thereof.

4. The apparatus of claim 1, wherein said angle of said at least one divider wall is at least 3° at said longitudinal ends and no more than 2° at a center thereof.

5. The apparatus of claim 1, wherein said angle of said at least one divider wall is in the range of 3-to 7° at said longitudinal ends and in the range of 1 to 2° at a center thereof.

6. The apparatus of claim 1, wherein said divider wall has an elongated central section, and wherein said angle remains constant within said central region and then increases beyond said central region.

7. The apparatus of claim 1, including a supply of molten metal having a higher co-efficient of contraction than pure aluminum connected to said means for feeding metal for said inner layer.

8. The apparatus of claim 7, wherein said supply of molten metal is a supply of an aluminum-magnesium alloy containing at least 2.5 wt. % Mg.

9. The apparatus of claim 1, including a supply of molten metal connected to said at least one means for feeding another metal, said molten metal being a metal having a lower coefficient of contraction than said metal fed to said inner layer.

* * * * *